US005579933A

United States Patent [19]

Hofmann

[11] Patent Number: 5,579,933

[45] **Date of Patent: *Dec. 3, 1996**

[54] SAFETY CONTAINER AND DISPENSER FOR SMALL ITEMS

[75] Inventor: Richard W. Hofmann, Chicago, Ill.

[73] Assignee: Magenta Corporation, Chicago, Ill.

[ * ] Notice: The term of this patent shall not extend beyond the expiration date of Pat. No. 5,372,267.

[21] Appl. No.: 354,234

[22] Filed: Dec. 12, 1994

Related U.S. Application Data

[63] Continuation-in-part of Ser. No. 85,632, Jun. 30, 1993, Pat. No. 5,372,267.

[51] Int. Cl.[6] ..... B65D 55/02

[52] U.S. Cl. ..... 215/220; 215/214; 215/217; 221/4; 221/154; 221/306; 206/536

[58] Field of Search ..... 206/528, 536, 206/537, 540; 215/214, 217, 220, 223, 233, 343; 221/4, 154, 306

[56] References Cited

U.S. PATENT DOCUMENTS

| | | | |
|---|---|---|---|
| 2,752,060 | 6/1956 | Martin | 215/217 |
| 3,095,085 | 6/1963 | Meijer | 206/536 |
| 3,402,842 | 9/1968 | Millian | 215/217 |
| 3,678,884 | 7/1972 | Robbins | 206/536 |
| 4,007,850 | 2/1977 | Beaugrand | 215/217 |
| 4,784,288 | 11/1988 | Jennings | 206/536 |
| 4,971,203 | 11/1990 | Weinstein | 206/536 |
| 5,099,999 | 3/1992 | Balien | 206/536 |
| 5,129,533 | 7/1992 | Loffler | 215/343 |
| 5,141,129 | 8/1992 | Jennings | 206/536 |

FOREIGN PATENT DOCUMENTS

| | | | |
|---|---|---|---|
| 1051007 | 12/1966 | United Kingdom | 215/343 |

*Primary Examiner*—David T. Fidei
*Attorney, Agent, or Firm*—Laff, Whitesel, Conte & Saret, Ltd.

[57] ABSTRACT

A child-resistant container according to the present invention has a container body and a cup-shaped closure which is installed telescopically over the open end of the container body. Mating longitudinal splines and ribs are provided on the adjacent walls of the container body and the closure to interfere with one another as the closure is longitudinally urged from a closed position to an open position. The spline and rib patterns are selected so that the splines and ribs interfere unless the closure is oriented in a predefined angular unlocked position with respect to the container body. The splines and ribs may be irregularly sized or circumferentially spaced along the walls. A cylindrical ledge of slightly increased diameter is provided on the container body longitudinally adjacent the splines. Additional interference ledge segments may be provided on the container body and the closure on or between the splines and ribs. The interference ledge and segments prevent a user from mechanically discovering the unlocked position by rotating the closure and feeling reduced resistance when the unlocked position is reached. A cylindrical plug seal is extends from a top wall of the closure to engage the open end of the container body when the closure is in the closed position.

29 Claims, 8 Drawing Sheets

Fig. 1
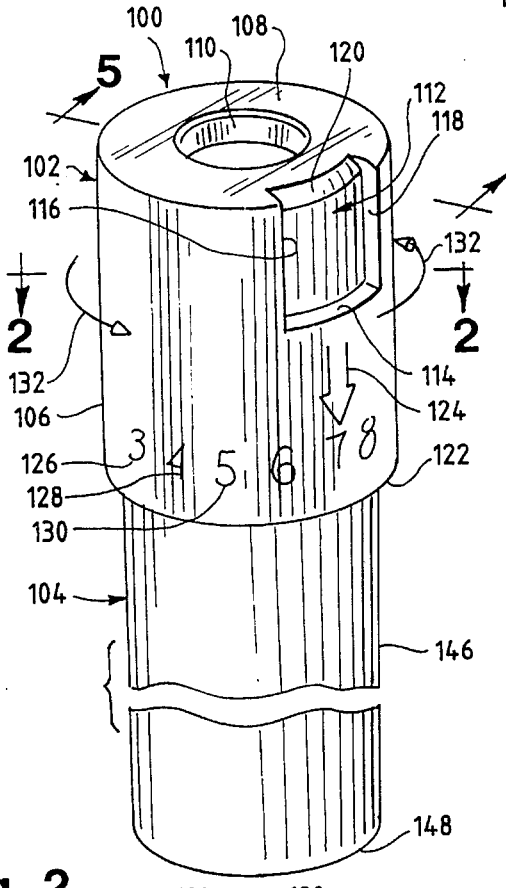
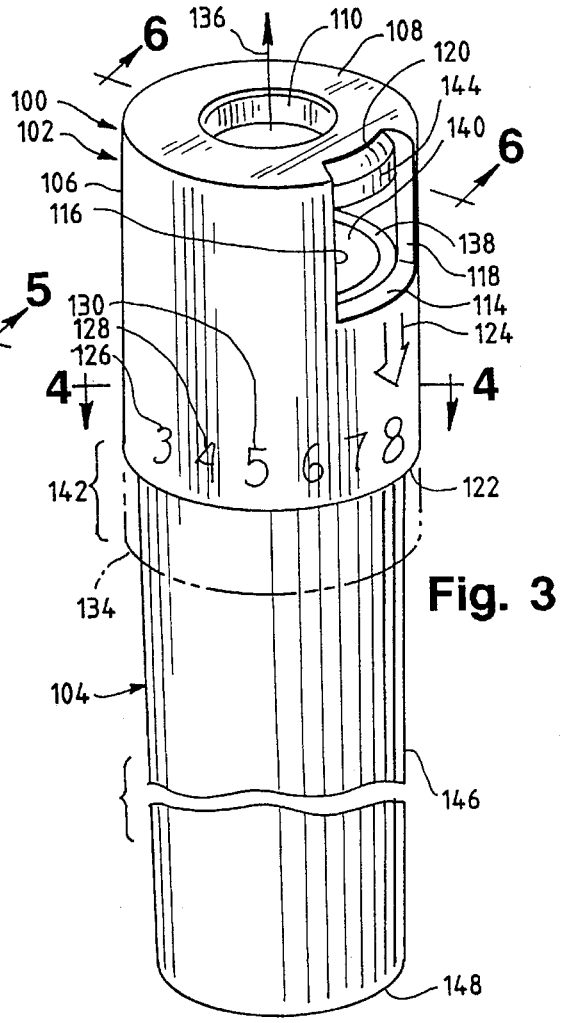
Fig. 3
Fig. 2
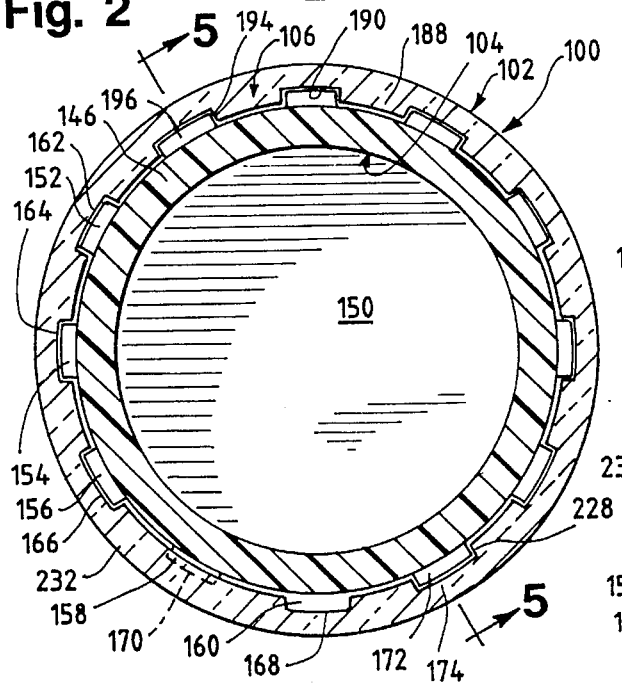
Fig. 4
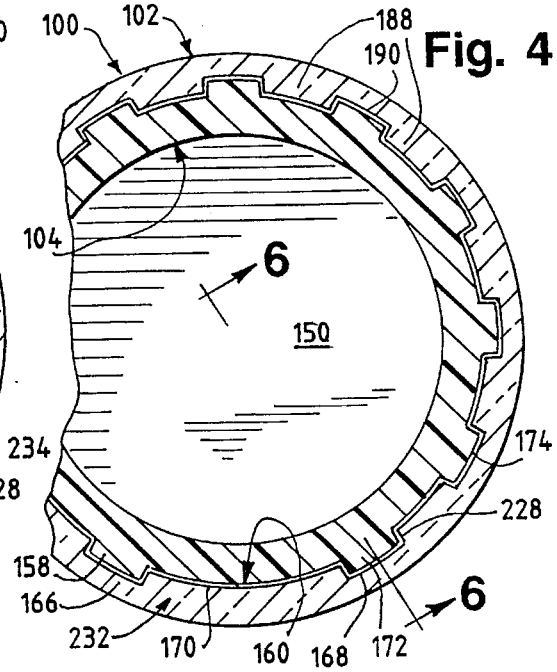

Fig. 15
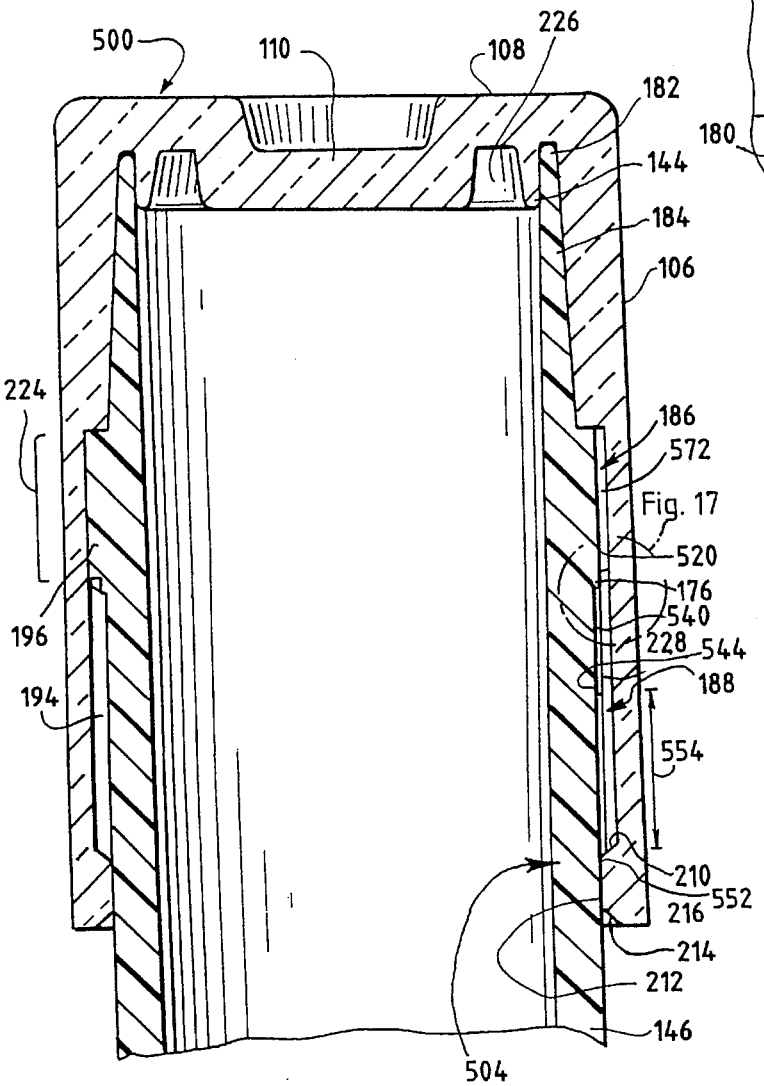
Fig. 16
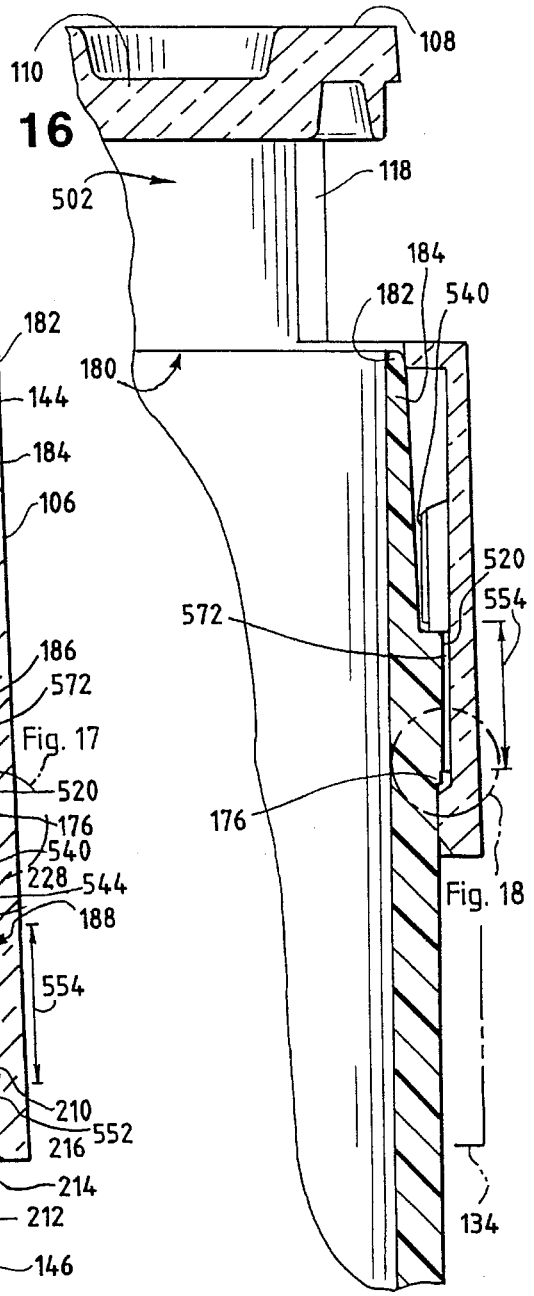
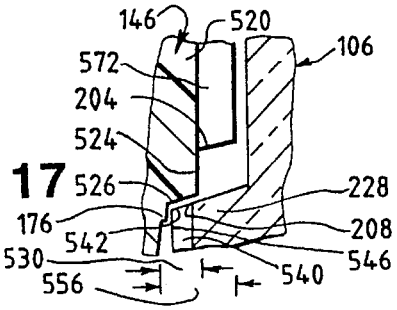
Fig. 17
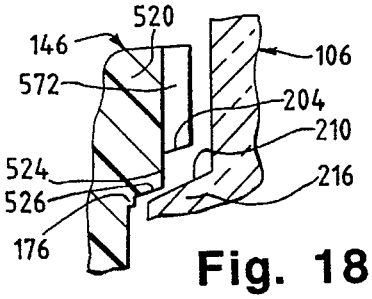
Fig. 18

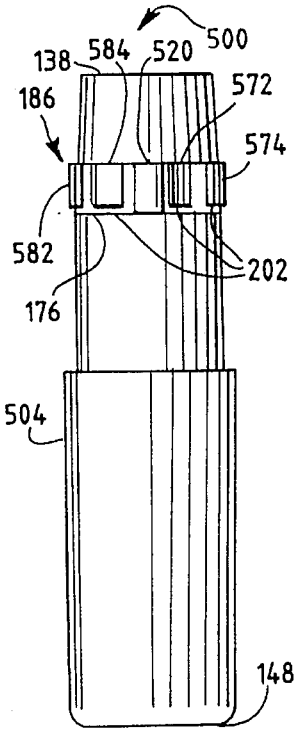
Fig. 19
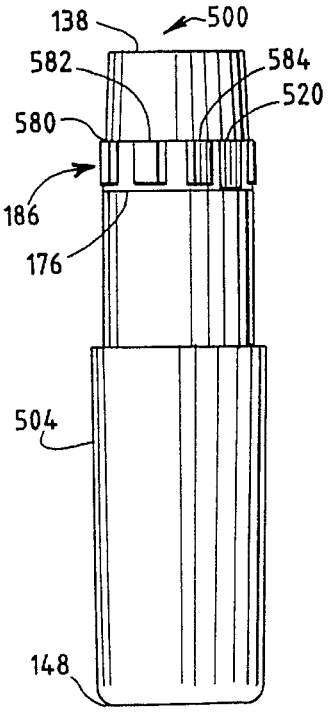
Fig. 20
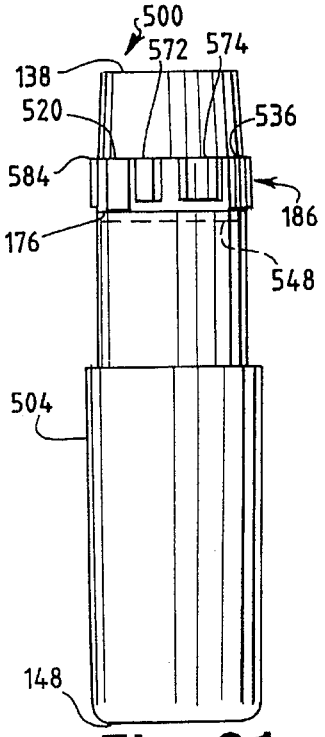
Fig. 21
Fig. 22A
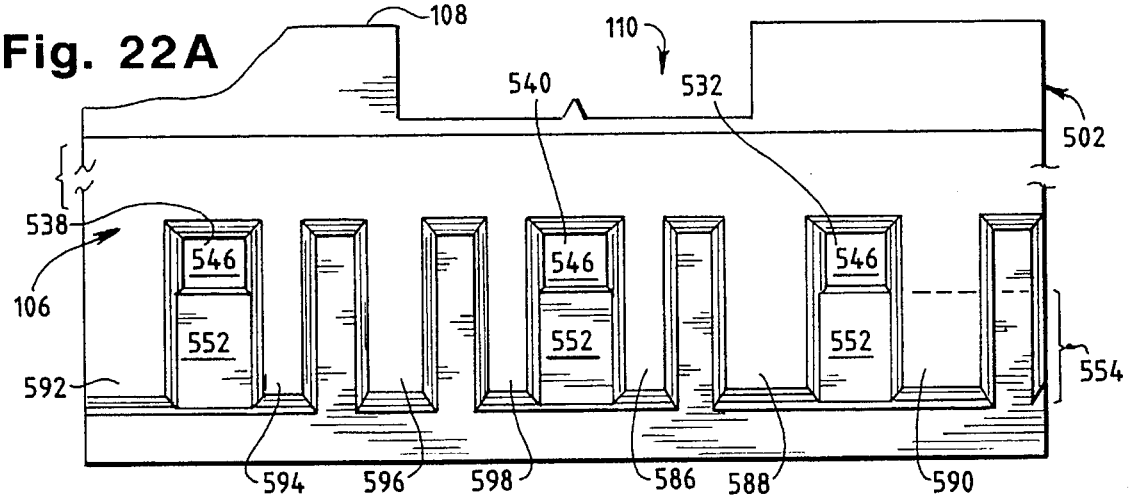
Fig. 22B
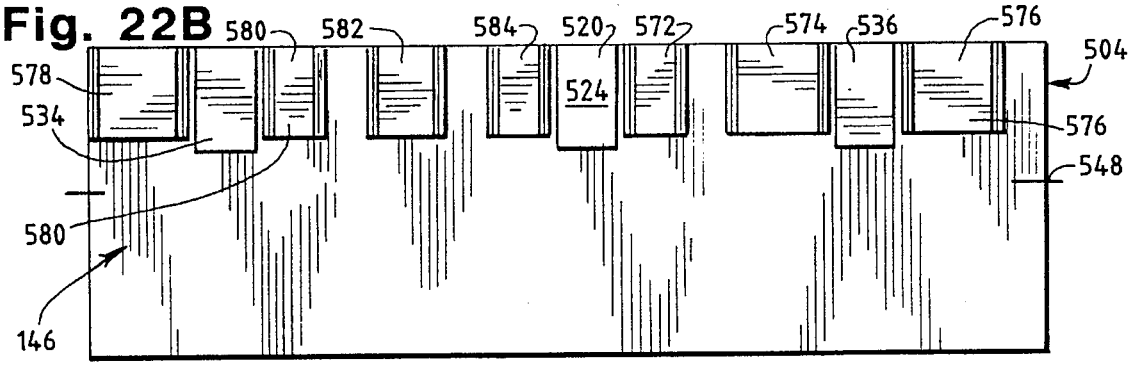

SAFETY CONTAINER AND DISPENSER FOR SMALL ITEMS

CROSS REFERENCES TO RELATED APPLICATIONS

This application is a Continuation-in-Part of my application Ser. No. 08/085,632, filed Jun. 30, 1993, now U.S. Pat. No. 5,372,632.

BACKGROUND OF THE INVENTION

This invention relates to containers for small items, and more particularly to containers for convenient use by an adult to store and dispense pills, capsules, or other small articles, while generally prohibiting access to such articles by children.

A variety of products, such as medicines, dietary supplements, and the like, are distributed in the form of small pills, tablets, or capsules. Although these products may be safe and effective when used properly, they can be extremely dangerous if improperly used, and the potential for improper use by children is especially high. Often, the size, shape, and bright colors of these items makes them resemble candy or other foodstuffs. Many children may be too young to appreciate the danger of eating things they are not supposed to, and even those who understand that some things should not be eaten may be unable to distinguish items which are safe to eat from potentially dangerous items.

Unfortunately, most pills and similar items cannot be made inherently safe from improper use by children and others who may be unable to appreciate the danger presented by the product. Accordingly, a variety of child-resistant containers have been developed to contain such products, permitting access to the contents by adults while precluding access to the contents by children. Many typical child resistant containers have the general size and shape of a conventional pill or tablet container, but include a child-resistant closure to prevent a child from gaining access to the contents. Such closures generally include an obstacle feature which is intended to be relatively difficult for a child to avoid but which is intended to be easily overcome by an adult.

For example, some of these closures require the user to undergo a relatively complicated or difficult-to-understand operation in order to open the container. The nature of the operation is usually not apparent from the structure of the container, but is explained by instructions printed upon the container or closure. Thus, a user must be able to read, understand, and remember an abstractly complex series of mechanical operations in order to release the closure. This obstacle tends to preclude operation by those children who are to young to appreciate the danger of consuming the contents of the container.

In addition to the abstract complexity of the operation which is required to release the closure, the operation is typically made difficult for a child to perform, by requiring significant strength, manual dexterity, or the ability to do several things simultaneously. For example, one common closure used with certain containers for prescription medications requires the user to urge the closure toward the container with significant force, while simultaneously rotating the closure with respect to the container until the closure is released. Another closure, commonly used with certain containers for non-prescription medicine, requires the user to angularly align a single index mark on the closure with a mating index mark on the container, and then apply significant upward pressure to a specific location on the closure, until it is released.

Unfortunately, although some of these known containers and closure combinations are effective in preventing children from opening the container, they are sometimes also effective in preventing the intended adult users from opening the containers. Many potential users suffer from one or more conditions which impair their strength or manual dexterity, and some of these people find opening the known containers difficult or impossible. This is a significant disadvantage, because people who are ill and therefore need medication are the most likely to suffer from a condition which exacerbates the difficulty of opening the container.

Another disadvantage of known containers is that when the closure is removed, a large opening is exposed through which many items may pass easily. This makes it easy to lose a substantial portion of the container contents if the container is accidentally upset. People who have conditions which impair their strength or manual dexterity may be more likely to upset the container.

Also, since the closure of known containers must be completely removed from the container to remove the contents, the closure is also subject to loss.

Further, a typical medication user needs only a small number of items of a particular type at any one time. For example, a user of an aspirin-containing pain relief medication might take one or two tablets at a time. Despite this usage pattern, conventional containers do not facilitate isolating and removing one or two of the items for use at one time. Instead, when a conventional pill container is employed, the user may insert his or her fingers into the container to select an item and drag it along an interior wall until it reaches the mouth of the container where the item may be grasped. This exposes all of the remaining items to contamination from extraneous matter carried on the user's fingers. Alternatively, the user may try to tip the container such that a desired number of items fall out. However, it is difficult to cause exactly the desired number of items to fall out. If more than the desired number fall out, the user must return them to the container, thereby exposing the unused items to contamination or loss. Although at first glance these may seem to be trivial barriers to use, there are persons having various impairments for whom extracting a desired number of items from a conventional container is very difficult.

U.S. Pat. No. 4,971,203 to Weinstein discloses a child-resistant pill dispenser which dispenses a small number of items. Weinstein discloses a cylindrical container body having a closed end and an open end. A cup shaped closure having an inner diameter slightly larger than the outer diameter of the container is telescopically mounted to cover the open end of the container. In one embodiment, the closure has a retaining peg or cam which engages a retaining groove provided on the container. The retaining groove is generally circumferential, but has attached thereto an additional section extending longitudinally toward the open end of the container. The retaining groove and cam cooperate so that when the cam is in the circumferential portion of the groove, the closure may generally rotate but is retained in a first longitudinal position. However, when the closure is rotationally positioned so that the cam can follow the retaining groove's longitudinal extension, the closure may be longitudinally displaced a small distance away from the container's closed end to a second longitudinal position. (In another embodiment, a retaining groove is provided on the closure, and a cam is provided on the container, but the components cooperate in much the same way.)

A dispensing orifice is provided in the container body near the open end. This dispensing orifice is normally covered by the closure. However, the closure has a matching orifice which is so located that the two orifices are overlappingly aligned only when the closure is in its second longitudinal position. Thus, in order to dispense an item, the closure must first be rotated to a predetermined rotational position to align the cam with the retaining groove's longitudinal extension, and then must be longitudinally displaced to align the dispensing orifices.

The Weinstein dispenser suffers from several significant disadvantages. Because the retaining groove's longitudinal extension section is connected to the circumferential section, the extension portion may be discovered by rotating the closure while applying slight pressure in the direction of the extension. When the cam reaches the extension, a slight bump may be felt, or the cam may enter the extension. Thus a child who happens upon the Weinstein dispenser and plays with it may easily defeat its child-resistant feature.

Another disadvantage of the Weinstein dispenser is when the closure is in its open, longitudinally displaced position, items in the container may become lodged between the open end of the container and the closure, thereby preventing the closure from being returned to its normal (closed) position. Also, Weinstein lacks a seal between the container and the closure, permitting moisture and extraneous materials to enter the container, even when closed, thereby contaminating the contents.

Another disadvantage is that the Weinstein dispenser is expensive and difficult to construct with modern automated equipment. Weinstein's dispensing orifices are oval-shaped and positioned in a manner that makes fabrication by popular and inexpensive injection molding techniques difficult, and requires additional manufacturing operations. Also, due to the configuration of the retaining groove and mating cam, the closure and the container must be suitably oriented in a predefined relationship when assembled together. It may also be necessary to install the cam as a separate manufacturing operation after the closure and the container have been assembled.

OBJECTS AND SUMMARY OF THE INVENTION

It is therefore an object of the present invention to provide a container for pills, dietary supplements, and other items which prevents children, and others unable to appreciate the dangers of improper use, from gaining easy access to the contents.

It is a further object of the invention to provide a container for small, potentially dangerous, solid items which allows intended users convenient access to the contents while denying access to children and other unintended users.

It is another object of the invention to provide a child resistant container having a security feature which presents an obstacle which must be overcome in order to gain access to the contents and which includes an additional feature to prevent children and others from discovering how to defeat the obstacle.

It is a further object of the invention to provide a child resistant container having a closure which must be placed in an unlocked position in order to gain access to the contents and which includes an additional feature to prevent children and other unintended users from discovering the unlocked position.

It is another object of the invention to provide a child resistant container which provides a seal between the container and its closure, thereby preventing infiltration of moisture and other contaminants.

It is another object of the present invention to provide a child resistant container and associated closure which may be conveniently and inexpensively manufactured using modern injection molding techniques and which requires a minimum of side operations to complete manufacture.

It is a further object of the present invention to provide a small child-resistant container for small, solid objects which conveniently dispenses one or a small number of objects at a time.

A child-resistant container constructed according to the present invention comprises a container body, which may be substantially cylindrical, having a closed end and an open end, and a cup-shaped closure which is installed telescopically over the open end of the container body.

A plurality of longitudinal splines are arranged in a circumferential band on the exterior wall of the container body near the open end, and a corresponding set of ribs and slots are provided on the interior wall of the closure body. The container splines and the closure ribs are longitudinally positioned so as to interfere with one another as the closure is longitudinally urged from a closed position to an open position. The spline and rib patterns are selected so that the splines and ribs interfere unless the closure is located in a predefined angular "unlocked " orientation with respect to the container body.

In one embodiment, the unlocking position is concealed from accidental discovery by a cylindrical ledge of slightly increased diameter provided on the container body longitudinally adjacent the splines.

In another embodiment, the unlocking position is concealed from accidental discovery by a plurality of interference ledge segments which are provided on the container body between the splines and which extend a small distance from the surface of the container body. Each interference ledge segment extends longitudinally toward the closure ribs a small distance further than the container splines so that as the closure is urged toward the open position, the interference ledge segments are encountered first. The ledges or ledge segments of these embodiments prevent a user from discovering the unlocked position by rotating the closure and feeling reduced resistance when the unlocked position is reached.

A cylindrical lip having a diameter slightly smaller than the diameter of the closure side wall extends inward from the closure top wall to form a seal. The seal engages the upper lip of the open end of container body when the closure is in the closed position, thereby preventing infiltration of moisture and other contaminants. A depression fills some of the interior space in the vicinity of the seal to prevent stored items from interfering with the seal.

In one embodiment, the closure is formed as a cup, and the closure must be separated from the container body in order to remove objects contained therein. In another embodiment, the container is adapted to conveniently dispense one or a small number of objects at a time. In this embodiment, the closure is generally cup-shaped, but has an aperture in its side wall. When the closure is in an open position, the closure wall aperture is located above the upper edge of the container body and forms a dispensing orifice through which items may be dispensed, one at a time. When the closure is in the closed position, the closure aperture is blocked by the body wall of the container body. The closure wall aperture is formed by relieving or omitting a portion of the cylindrical side wall of the closure from a bottom edge of the aperture through the top wall, with side edges extending parallel to a longitudinal axis of the closure. This enables the closure to be conveniently and inexpensively formed using modern injection molding techniques without requiring costly and time consuming side operations.

BRIEF DESCRIPTION OF THE DRAWINGS

These and other features of this invention will be best understood by reference to the following detailed description of a preferred embodiment of the invention, taken in conjunction with the accompanying drawings, in which:

FIG. 1 is a front perspective view of a first embodiment 100 of a safety container constructed according to the present invention, showing the container fully assembled and in its closed state;

FIG. 2 is a downward cross-section view of the safety container of FIG. 1, taken along section lines 2—2 thereof;

FIG. 3 is a front perspective view of the safety container of FIGS. 1–2, showing the container in its open state;

FIG. 4 is a downward cross-section view of the safety container of FIG. 3, taken along section lines 4—4 thereof;

FIG. 15 is a side cross-section view of the safety container of FIG. 14, taken along the section lines 15—15 thereof;

FIG. 16 is a side cross-section view of the safety container of FIG. 14, taken along the section lines 16—16 thereof;

FIG. 17 is an enlarged detail of a portion of the cross section view of FIG. 15, taken along the view indicator 17 thereof;

FIG. 18 an enlarged detail of a portion of the cross section view of FIG. 16, taken along the view indicator 18 thereof;

FIG. 19 an elevation view of the safety container of FIG. 14, taken along the view lines 19—19 thereof;

FIG. 20 is an elevation view of the safety container of FIG. 14, taken along the view lines 20—20 thereof;

FIG. 21 is an elevation view of the safety container of FIG. 14, taken along the view lines 21—21 thereof;

FIG. **22*a* is a development view of the closure for the safety container of FIG. 14 showing a projection of the interior surface of the closure onto a plane; and FIG. 22*b* is a development view of the safety container of FIG. 14** showing a projection of the exterior surface of the container onto a plane.

DETAILED DESCRIPTION OF THE PREFERRED EMBODIMENT

Figure 10:
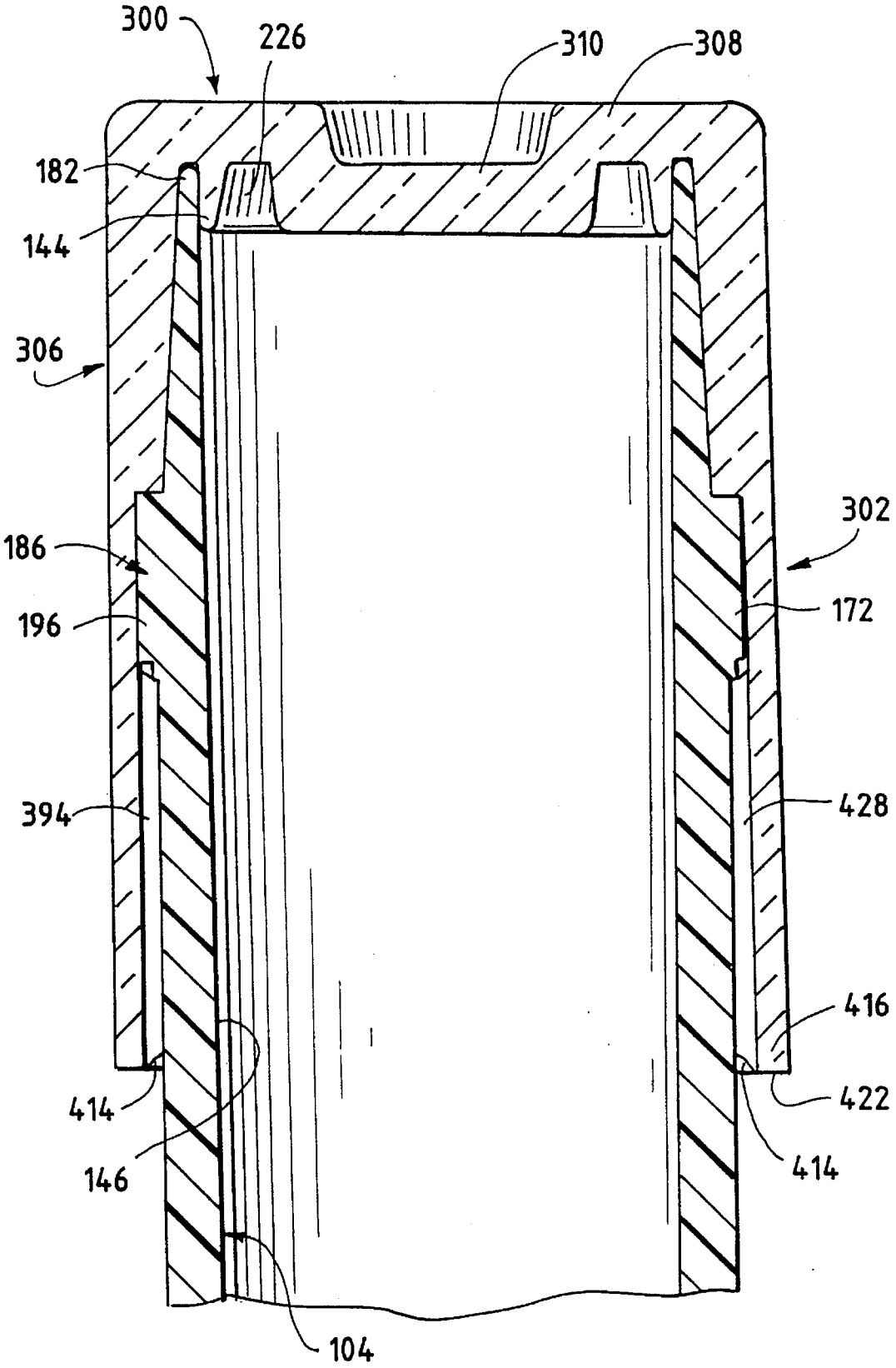
FIG. 10 is a side cross-section view of a second embodiment 300 of a safety container constructed according to the present invention, showing the container in its closed position.
Figure 11:
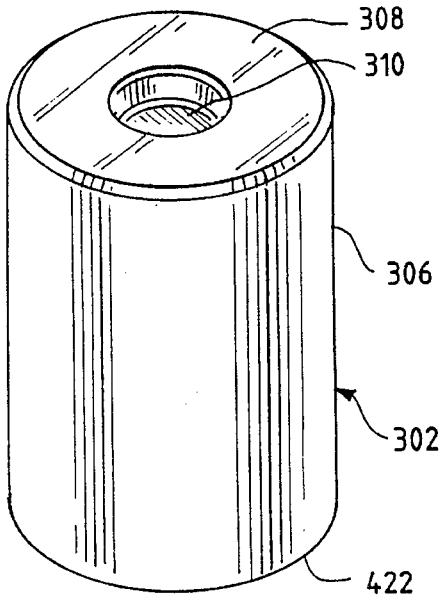
FIG. 11 is a front isometric view of a closure 302 for use with the a safety container 300 of FIG. 10.

A first embodiment 100 of a safety container constructed according to the present invention is shown in FIGS. 1–9. A second embodiment 300 of the container is shown in FIGS. 10–11. A third embodiment 500 of the container is shown in FIGS. **14–22*b***.

In brief, containers 100, 300 and 500 are each child-resistant safety containers intended to store a plurality of small items, such as pills, tablets, capsules, or the like, which are commonly used as delivery vehicles for medicines, dietary supplements, and other pharmacological products. Although it is contemplated that the containers 100, 300 and 500 are likely to be highly useful for storing ingestible, health-related products, the containers would also be useful for storing any other small, discrete, substantially solid objects, to which children, and others who may be unable to appreciate the danger of improper use, should be denied access. For convenience, the term "items " is used herein to denote any object to be stored in the containers 100, 300 and 500.

The containers 100, 300 and 500 are generally similar, but the container 100 provides additional features in order to conveniently dispense a small number of items at one time. A description of container 100 will be provided first, followed by a description of the differences between container 100 and container 300 and container 500. In general, identical reference numbers will be used to refer to identical elements of the containers 100, 300 and 500.

Figure 9:
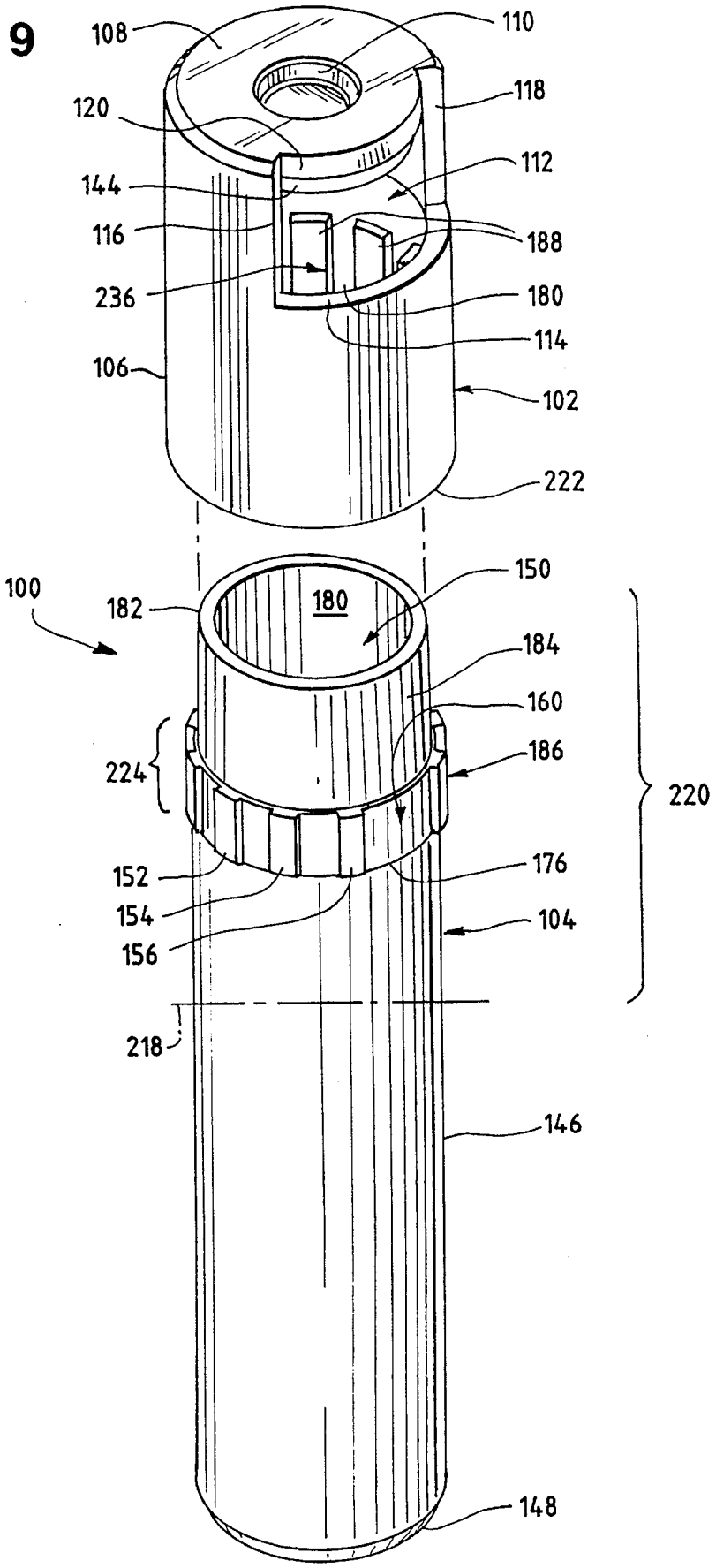
FIG. 9 is an exploded front isometric view of the safety container of FIG. 1, showing separately a container portion and a closure portion thereof.

The general structure of safety container 100 is best seen in FIGS. 1, 3, and 9. Container 100 comprises a container body 104 and a mating closure 102. The container body 104 may be formed as an elongated tubular structure having a substantially cylindrical inner body wall 140 and outer body wall 146, a closed bottom end 148, and an open top end 138 defining container mouth 180. The inner body wall 140, closed bottom end 148, and container mouth 180 cooperate to define a container region 150 within the body 104 for containing objects of the type described above.

Although the container body 104 is shown in the drawings and described herein as substantially cylindrical, in fact, it is actually only necessary that the small upper portion 220 of the body 104 which interfaces with closure 102 (i.e., the portion 220 which is above the broken line 218 (FIG. 9)) have a particular shape to match the inner shape of the closure 102. The remainder of the lower portion of the body 104 could be any suitable shape or cross-section, and could, for example, incorporate at least one flat surface (not shown) to prevent the container from rolling off an inclined surface. Furthermore, the particular shape of the closure interface section 220 may be selected from a variety of shapes which are generally rotationally symmetric about a longitudinal axis of the body 104. A body 104 having the substantially cylindrical shape shown herein is believed to be preferable because it may be efficiently and inexpensively manufactured using commonly available injection molding techniques.

As best seen in FIG. 9, a closure interface portion 220 of the body 104 extending above the broken line 218 is adapted to interface with the closure 102. As shown herein, the closure 102 is generally cup-shaped and has an inside diameter which is slightly larger than the outside diameter of the container body portion 220. Thus, in order to close the container body 104, the open end 222 of the closure 102 is fit over the open end 180 of container body 104 in an overlapping telescoping relationship.

The closure interface portion 220 comprises the open end 180 of the container body 104, the upper lip 182 of the body, a transition section 184 of the body immediately below the lip 182, and locking means 224. The transition section 184 is preferably conically tapered between the locking means 224 and the upper lip 182 so that its outside diameter is slightly reduced as the upper lip is approached.

The locking means 224 performs the dual functions of retaining the closure 102 in desired positions with respect to the body 104 and preventing children, and others who may be unable to appreciate the danger of improper use of the contents, from opening the container. As best seen in FIGS. 5–9, the locking means 224 comprises a circumferential interference ledge 176 immediately below the transition section 184, and a group of splines 186 arranged in a substantially regular pattern along the circumferential ledge. The interference ledge 176 is formed by creating a horizontal band of slightly larger diameter on the outside of the container body. The splines 186 are formed as longitudinally-extending strips of further increased diameter. The function of the locking means 224 will be described infra in greater detail.

As best seen in FIGS. 1, 3, and 9, the closure 102 is generally cup-shaped and comprises a substantially cylindrical body wall 106 having one end closed by an end wall 108, and the remaining end 222 open. As best seen in FIG. 9, closure 102 has a second locking means 236 located on the interior surface of the closure body wall 106. The second locking means 236 cooperates with the locking means 224 of the container body 104 to provide a child-resistant access feature, and for retaining the closure 102 in desired positions with respect to the container body 104. The locking means 236 will be described infra in greater detail.

A dispensing orifice 112 is preferably provided in the wall 106. The dispensing orifice is defined by left and right side edges 116, 118, a bottom edge 114, and a top edge 120. The orifice may be created by relieving or omitting to form the portion of the wall 106 defined by these edges. Preferably, the omitted wall portion extends longitudinally upward from the bottom edge 114 through the top 108 of the closure, and the left and right side edges 116, 118 are preferably substantially parallel with the longitudinal axis of the closure 102. When commonly available injection molding techniques are used, these constraints permit the orifice to be molded in the direction of the draw and avoid the need for side actions, thereby reducing the cost and complexity of the mold, and improving the molding cycle time.

Figure 5:
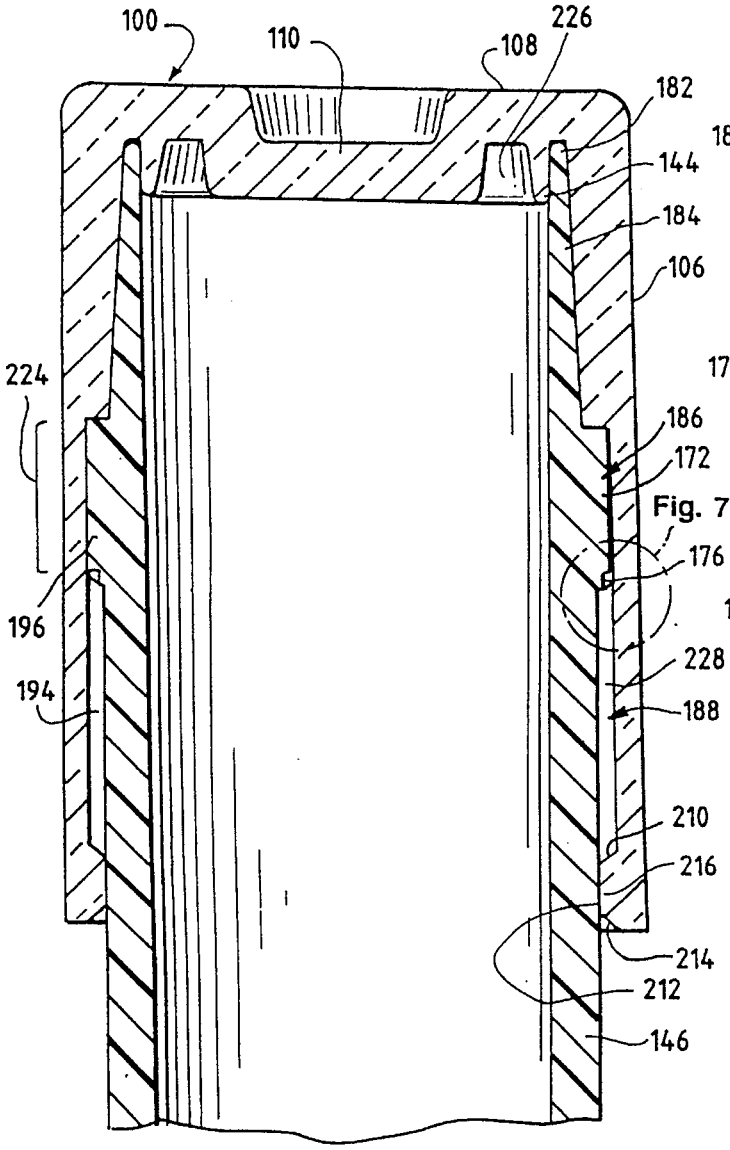
FIG. 5 is a side cross-section view of the safety container of FIG. 1, taken along the section lines 5—5 thereof.

As best seen in FIGS. 1, 3, 5, 6, and 9, the closure 102 preferably has a seal means which cooperates with the container body 104 to seal the container when the closure 102 is in a closed position (see FIGS. 1 and 5). The seal means may be formed by any suitable seal, gasket, or the like. The seal means 144 is preferably formed as a cylindrical lip 144 which extends downward from the interior surface of the closure top wall 108. The cylindrical lip 144 thus forms a plug which extends into the open end 180 of the container body when the closure 102 is in the closed position (see FIG. 5). Preferably, the cylindrical lip 144 is resilient and has an outer diameter which is slightly larger than the inner diameter of the upper lip 182 of the container body 104. Urging the closure 102 downward into the closed position causes the lip 144 to be compressed inwardly, producing a tight interference seal with the inner surface 140. This seal means advantageously prevents contaminants, such as dust and water vapor, from entering the container when it is intended to be closed.

The closure 102 preferably includes a depression 110 in the top wall 108. The depression 110 helps prevent items from catching on the lip 144, which otherwise might interfere with dispensing. An empty region 226 is provided between the lip 144 and the depression 110 so that the depression does not affect the resilience of the lip 144 or its movement when being compressed.

As best seen in FIGS. 1, 3, 5, and 6, when the container body 104 and the closure 102 are assembled to form the container 100, the closure 102 has a closed position (FIGS. 1 and 5), and an open position (FIGS. 3, 6) in which the closure 102 is displaced upwards (indicated by arrow 136) by a distance 142 (FIG. 3) from the closed position (indicated in FIG. 3 by the phantom line 134). The container body 104 has a locking means 224 which cooperates with a corresponding locking means 236 on the closure.

Although any appropriate cooperative locking means 224, 236 could be used, as best seen in FIGS. 2 and 4–9, a preferred locking means according to the present invention incorporates a plurality of longitudinal splines 186 arranged circumferentially on the exterior surface of the container body 104, and a corresponding plurality of longitudinal slots 190 on the interior surface of the closure body 106 for receiving the splines 186. Slots 190 are preferably formed as the vacancies between opposing ribs 188 on the interior surface of the closure body.

As best seen in FIGS. 2 and 4, preferably the splines 186 are provided at regular angular intervals about the circumference of the container body wall 146, as shown by exemplary equally sized splines 196, 152, 154, 156, 158, and 172. However, one spline is omitted at one of the regular intervals 160. Corresponding slots 190 are provided at equivalent angular intervals about the inner surface of the closure body 106 as shown by exemplary slots 194, 162, 164, 166, and 174. A slot is omitted at one of the regular intervals 170. The omitted spline position 160 and the omitted slot position 170 cooperate to form a key rib 232 and a key slot which mate only when the closure 102 is in a single predefined angular orientation with respect to the container body 104. Only in that orientation can the closure be pulled up into the open position. The predefined angular orientation is referred to herein as the "unlocked " orientation.

Figure 7:
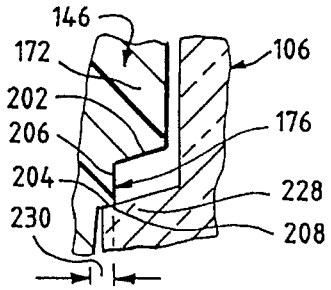
FIG. 7 is an enlarged detail of a portion of the cross section view of FIG. 5, taken along the view indicator 7 thereof.

As best seen in FIGS. 5 and 7, when the closure 102 is in the closed position, the tops 208 of ribs 188 and slots 190 of the closure body 106 are located below the bottoms 202 of splines 186 of the container body 146. Thus, in most angular orientations of closure 102 with respect to container body 104, at least one of the exterior container body splines 186 will interfere with at least one of the ribs 188 on the interior of closure body 106, to prevent the closure 102 from moving upward into the open position.

In several angular orientations, all but one of the exterior container body splines 186 will be aligned directly above a slot 190 on the interior of closure body 106. However, a remaining spline will be above the omitted slot position 170 on the closure body 106, and therefore, this remaining spline will interfere with the interior wall of the closure body 106. For example, as shown in FIG. 2 splines 152, 154, 156, etc. are respectively aligned with slots 162, 164, 166, etc. However, spline 158 is aligned with the omitted slot position 170, so that spline 158 will interfere with the interior wall of the closure body 106 to prevent the closure from being raised to the open position.

Figure 6:
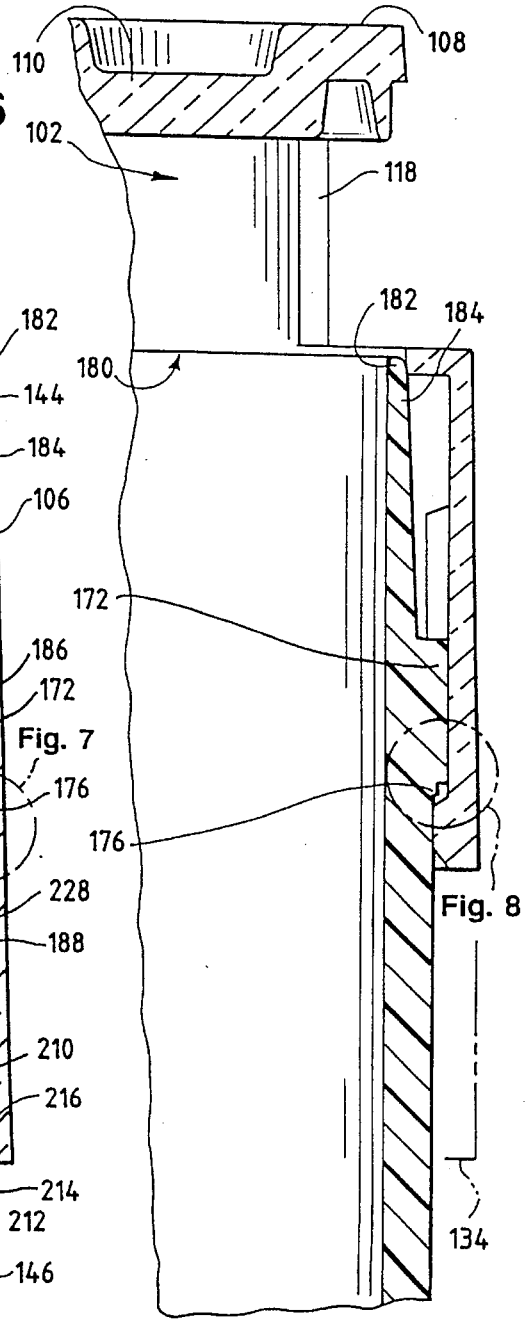
FIG. 6 is a side cross-section view of the safety container of FIG. 3, taken along the section lines 6—6 thereof.

As best seen in FIGS. 3, 4, and 6, only in a single predefined angular orientation, in which each of the container body splines 186 are aligned with a mating closure slot 190, and the omitted spline position 160 is aligned with the omitted slot position 170, no interference occurs between exterior splines 186 and interior splines 188, and only in that unlocked angular orientation can the closure 102 be raised to its open position.

A significant disadvantage of at least one known child-resistant dispenser having a moving closure with a position-dependent unlocking feature is that the unlocked position is easily discovered by applying slight pressure toward the open position while rotating the closure through various angles, as a child might do while playing. The unlocked position is easily felt in the known device because at that position, a cam or peg, which rides in a retaining groove to limit the movement of the closure, is permitted to enter a longitudinal spur of the groove. Thus, the known unlocking feature presents substantially reduced resistance to longitudinal movement in that position, and a user can easily detect this.

Accordingly, the locking means 224 of the present invention includes means to mask the unlocked angular orientation so that it cannot be easily discovered. As best seen in FIGS. 5, 7, and 9, the locking means 224 comprises a circumferential interference ledge 176 which extends a small distance below container body splines 186. The ledge 176 has a bottom face 204 and a side face 206 which are circumferentially continuous.

In order to raise the closure 102 into the open position, a user must apply upward pressure on the closure 102. When light to moderate upward pressure is initially applied to the closure, the splines 190 on the interior of the closure 102 first encounter the interference ledge 176. For example, as best seen in FIGS. 5 and 7, the upper inside corner 208 of closure spline 228 bears against and interferes with the bottom face 204 of ledge 176. This interference prevents the container body splines 186 from entering closure slots 190. Since ledge 176 is circumferentially continuous, the interference is constant regardless of the angular orientation of the closure, and thus, even if a user applies a child like rotation with minor upward pressure through any angular displacement, no reduced resistance to longitudinal movement toward the open position can be felt.

The container body 104 and the closure 102 are preferably constructed of a suitable resilient plastic material, such as polyethylene, a polyacrylic ester, or polypropylene. As increased upward pressure is applied to the closure 102, the resilience of the materials from which the container body 104 and closure 102 are constructed permits the interference from ledge 176 to be overcome.

If the closure 102 is in the unlocked angular orientation, then the container body splines 186 may enter the closure slots 190 without incident, and the closure may be displaced longitudinally to the open position. However, if the closure 102 is not in the unlocked angular orientation, the container body splines 186 will interfere with closure ribs 188 to prevent further longitudinal displacement of the closure 102.

The distance 230 (FIG. 7) by which the diameter of ledge 176 exceeds the diameter of the container body wall 146 may depend in part on the particular material from which the container body wall 146 and closure body wall 106 are constructed, and in part on other dimensions, such as the thickness of walls 106, 146, and the diameter of these parts. The ledge step distance 230 and the resilience of the wall materials will affect the amount of force required to overcome the interference of the ledge 176. Thus, selecting a suitable ledge step distance 230 may be important in providing a container which does not pose an unacceptable access barrier to intended users, who may have impaired strength and manual dexterity. In a tested commercial embodiment constructed of polypropylene, having a container body wall thickness 146 of 0.058 inches, a closure body wall thickness 106 of 0.025 inches, and a container body diameter of 0.656 inches, an interference ledge having a dimension 230 of 0.003 inches has been found suitable.

Figure 12:
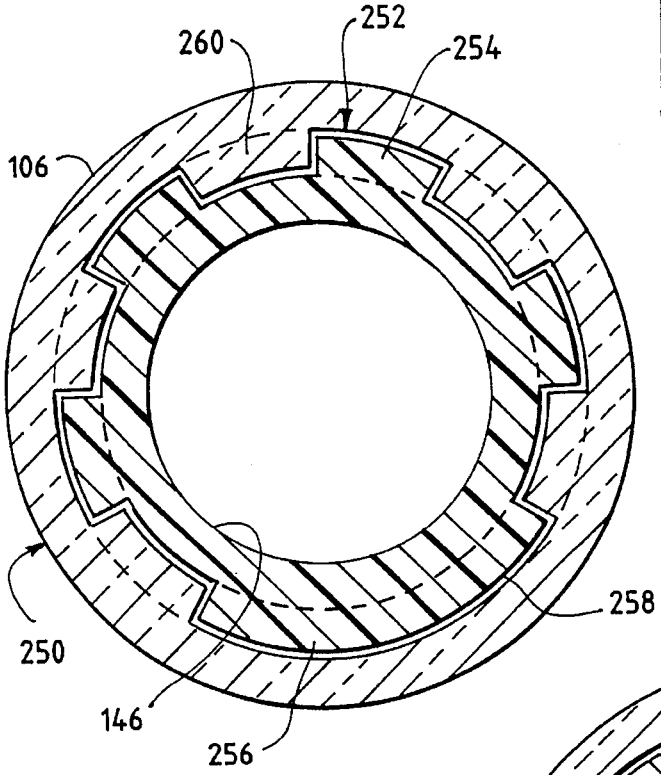
FIG. 12 is a cross-section view of a modified retaining means configuration for use with the safety containers of the present invention.
Figure 13:
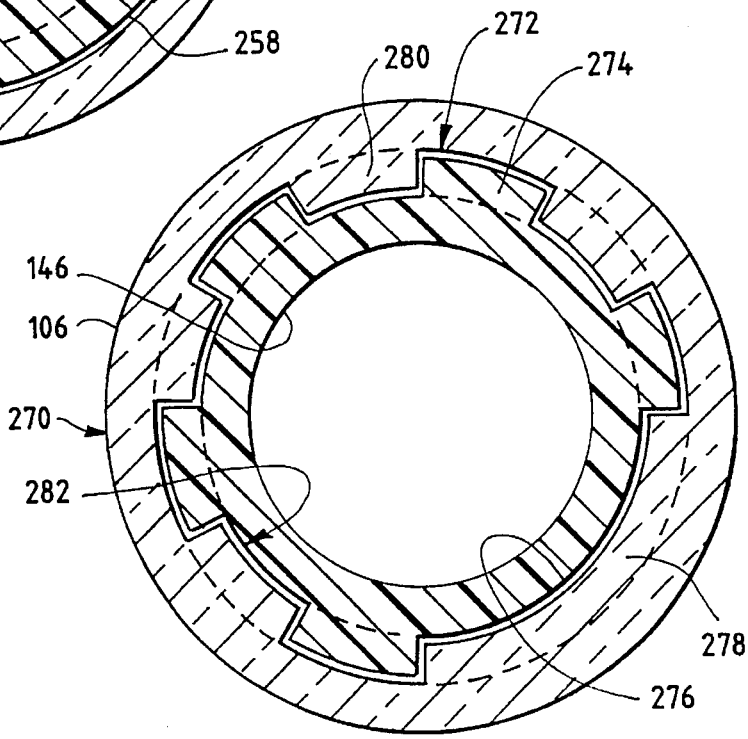
FIG. 13 is a cross-section view of another modified retaining means configuration for use with the safety containers of the present invention.

Although the previous discussion of the locking means 224, 236 and the associated figures have shown a particular arrangement of splines and corresponding slots, other arrangements could also be used. As best seen in FIGS. 12 and 13, the number of splines may vary, as may the relative sizes of the container splines and closure ribs. In addition, a key rib or key spline may be located on either the container body 104 or the closure 102, with a corresponding slot on the opposite part.

Thus, as shown in FIG. 12, a modified locking means 250 may comprise four ordinary splines 254 and one enlarged key spline 256 on the container body wall 146, along with five ordinary ribs 260 on the closure interior wall 106. Splines 254 and ribs 260 are approximately the same size. The ribs 260 form four ordinary slots 252 and one key slot 258 for receiving splines 254, 256 of the container body.

As shown in FIG. 13, a second modified locking means 270 may comprise five ordinary splines 274 on the container body wall 146, along with four ordinary ribs 280, and one enlarged key rib 278, on the closure interior wall 106. Splines 274 and ribs 280 are approximately the same size. The ribs 280 form slots 272 for receiving the splines 274 of the container body, and splines 274 form slots 282 for receiving ribs 278, 280 of the closure interior wall 106. Other alternative configurations could also be used. For example, each spline and rib could be a different size, provided that the splines and ribs form complementary slots for receiving one another in a predefined angular orientation of the closure 102 with the container body 104. A third embodiment 500 of a container constructed according to the present invention incorporating such a locking means configuration is described herein in detail in conjunction with FIGS. 14–22*b*.

Figure 8:
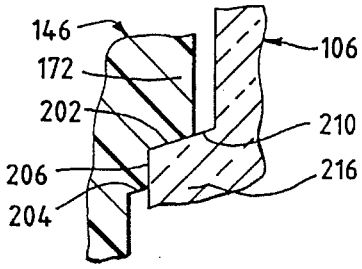
FIG. 8 is an enlarged detail of a portion of the cross section view of FIG. 6, taken along the view indicator 8 thereof.

Because container 100 conveniently dispenses the items stored therein as the user requires them, there is generally no need for the closure 102 to be separated from the container body 104 after the container has been filled and those parts have been assembled together. Further, if the closure 102 is separated from the container body 104, it may be lost. Accordingly, as best seen in FIGS. 5, 6, and 8, the closure 102 comprises means to retain it in operative attachment to the container body. A ring-shaped lip 216 projects inward from the interior of the side wall 106 of the closure near the open bottom end 122 thereof. The inner diameter of the closure lip 216 is smaller than the outer diameter of container body splines 186 (FIGS. 5–6) and 172 (FIG. 8) so that these parts will interfere. In order to assemble the closure 102 to the container body 104, the closure 102 is installed over the open end 180 of the container body, and sufficient downward pressure is supplied to deform the lip 216 and surrounding closure body wall 106 outward, so that the lip may pass the container body splines 186, 172. A chamfered lower edge 214 is provided on lip 216 to urge it to deform outwardly as it bears against the top of the splines 186, 172.

In normal operation (i.e., once the container body 104 and the closure 102 have been assembled), when the closure 102 is moved to its open position, the upper surface 210 (FIG. 8) interferes with the bottom edges 202 of splines 186 (FIGS. 5–6) and 172 (FIG. 8). Since the splines 186 extend virtually around the entire circumference of the container body 104, they effectively block the lip 216 from passing the splines. Thus, once assembled to the container body 104, closure 102 cannot be removed unless sufficient upward force is applied to deform the lip 216 so that it may pass the splines.

The container body 104 and the closure 102 preferably provide means for identifying the unlocked angular orientation in a manner which intended adult users will easily understand, but children will not. For example, as shown in FIGS. 1 and 3, a plurality of indicia 126, 128, 130 may be provided at various positions on the exterior of the container body 104, and an index mark 124 may be provided on the closure 102. The intended user is preferably advised of the particular indicium to which the index mark 124 must point in order to place the closure in the unlocked angular orientation.

There are several ways in which the intended user might be advised of the indicium corresponding to the unlocked location without making that indicium apparent to children and other users. For example, as illustrated in FIGS. 1 and 3, the indicia may be arabic numerals, and the user may be told orally of the numeral corresponding to the unlocked location by a pharmacist or technician. Alternatively, the corresponding numeral could be inscribed somewhere on the container or on a drug information sheet which may accompany the product when the user receives it. However, it is possible that a child may see the numeral on one part of the container, recognize that it corresponds to one of the position indicia, and defeat the locking means.

Accordingly, it would be preferable that if the unlocked position is identified on the container, the spelled-out name of the corresponding numeral be used, so that persons who cannot read, such as young children, would be unable to recognize it. Distinctive shapes, colored dots, and other indicia could be substituted for the numerals shown in FIGS. 1 and 3. Other indicia could also be used.

A second embodiment 300 of a container constructed according to the present invention is shown in FIGS. 10–11. The second embodiment 300 is similar to the first embodiment 100, but lacks the dispensing feature of the first embodiment 100. Since no portion of the container body 104 is directed to the dispensing feature, the container body 104 of the second embodiment 300 may be identical to that of the first embodiment 100.

Closure 302 is similar in most respects to closure 102 and is generally cup-shaped and comprises a substantially cylindrical body wall 306 having one end closed by an end wall 308, and the remaining end 422 open. Since closure 302 lacks the dispensing feature, no dispensing aperture is required, and the body wall 306 may be continuous. As best seen in FIG. 10, closure 302 preferably comprises a locking means, including longitudinal ribs 394, 428 for cooperation with the locking means 224 of container body 104.

Since closure 302 must be removed from the container body 104 in order to remove items, closure 302 preferably lacks the ring-shaped retaining lip 216 of closure 102. Instead, longitudinal ribs 394, 428 may extend downward to a location 416 near the open end 422 of closure 302. Since closure 302 lacks a retaining lip 216, only normal effort is required to install or remove the closure 302 once it has been located in the unlocked angular orientation. A chamfered bottom edge 414 may be provided on ribs 394, 428 to further aid installation of the closure on the container body. The container for closure 302 of course preferably has the interference edge 176.

A third embodiment 500 of a container constructed according to the present invention is shown in FIGS. **14–22*b*. The third embodiment 500 is similar to the first embodiment 100, but as will be discussed further, employs different means for concealing the unlocking position of the cap, and a modified arrangement of splines and slots forming the locking means. Accordingly, only those aspects of the third embodiment 500 which differ from the first embodiment will be discussed in detail. In general, identical reference numbers will be used to refer to identical elements of both containers 100, 500**.

As best seen in FIGS. 15–16, container 500 comprises a substantially cylindrical body portion 504 and a cup shaped closure portion 502, which may be generally similar to the body portion 104 and closure portion 102 of container 100.

As best seen in FIGS. **14–22*b*, the locking means structure of container 500 employs a plurality of longitudinal locking splines 572, 574, 576, 578, 580, 582, and 584 circumferentially arranged on the outer surface of the body portion 504. A plurality of ribs are provided on the interior surface of the closure portion 502. The ribs form respective complementary slots 586, 588, 590, 592, 594, 596, and 598 for receiving the splines when the closure 502 occupies a suitable mating orientation with respect to the container body 504**.

Figure 14:
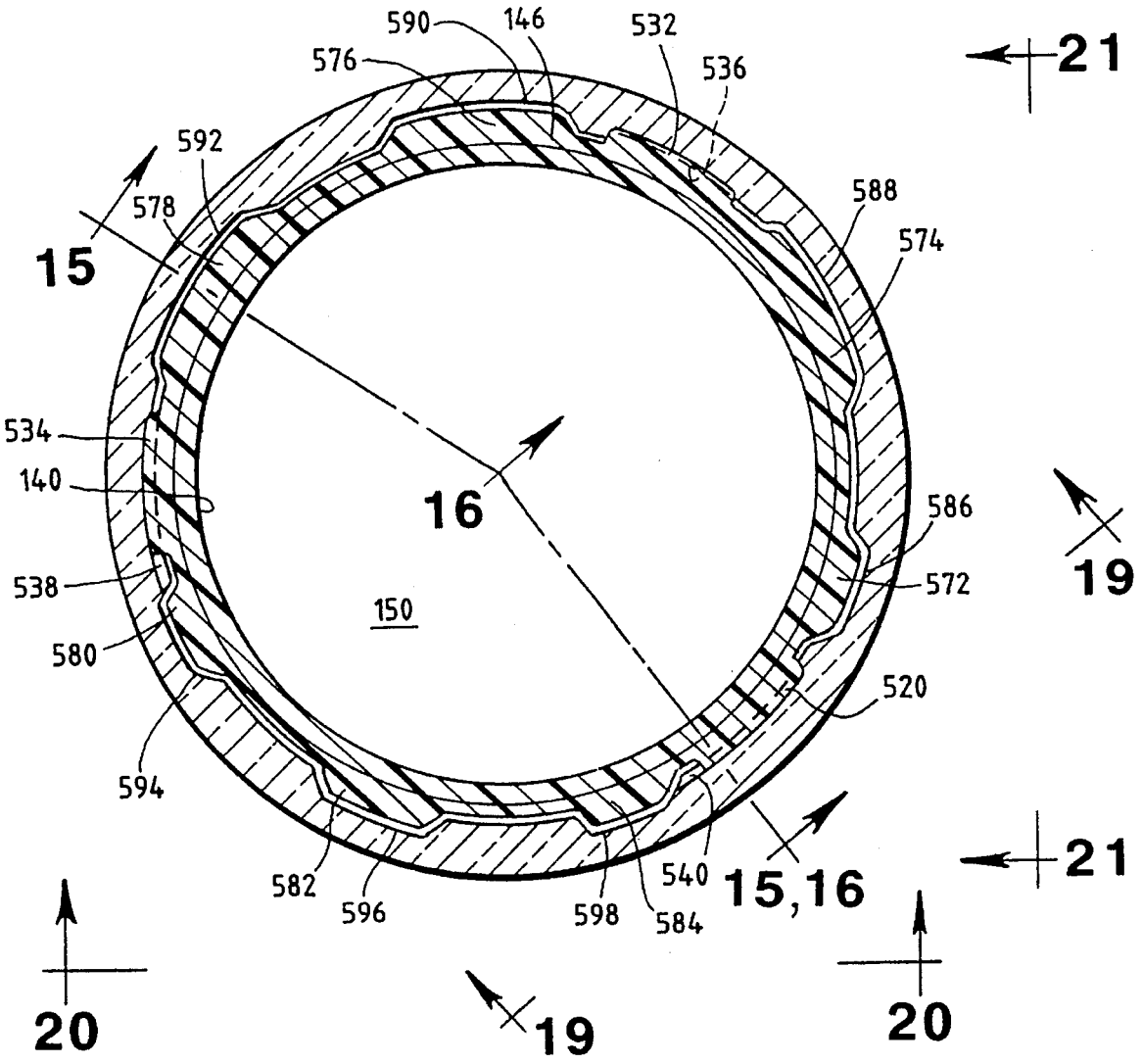
FIG. 14 is a downward cross-section view of a third embodiment 500 of a safety container constructed according to the present invention, showing the container fully assembled and in its closed state.

The container body splines and closure slots are preferably provided in an irregular arrangement selected such that they will mate only when the closure 502 occupies a single predefined angular orientation or "unlocking position" with respect to the container body 504. The arrangement may be irregular in that the size of splines (i.e. their angular extent along the container body circumference), or their spacing from each other, may vary. As best seen in FIGS. 14,**22*a*, and 22*b***, in a preferred embodiment, both the size of the splines and the spacing between them vary.

An irregular arrangement of splines may provide advantages over a regular or uniform arrangement of splines in which one spline is keyed in some way. Where a uniform arrangement of splines is used, there are typically several angular orientations of the closure with respect to the container body in which the container splines interfere with the closure ribs at only one or two places. As a result, an unauthorized user may be able to defeat the locking means by applying additional force or by skewing or deforming the closure to overcome the interference at those places. Where an irregular arrangement of splines is used, whenever the closure is displaced from its unlocking orientation, the container splines typically interfere with the closure ribs at several places, and those places are distributed along the circumference of the container. Consequently, even where the container is constructed of a flexible material, it is difficult to overcome all of the interferences simultaneously.

As noted above with respect to embodiments 100 and 300, it is highly desirable to provide in a child-resistant safety container means for preventing an unauthorized user from mechanically discovering the unlocking position through play or experimentation. Accordingly, the safety container 500 provides an unlocking position concealment means comprising a plurality of interference members 520, 534, and 536, on the container body 504, and a plurality of cooperative interference 532, 538, and 540, on the closure 502. The interference members 520, 534, 536, 532, 538, and 540 may be provided to replace the interference ledge 176, but preferably they are provided in addition to the interference ledge to further improve the concealment of the unlocking position.

Interference members 520, 534, and 536 are preferably formed as small pads which are located on the exterior surface 146 of the container body 504 substantially between selected adjacent pairs of locking splines 572, 574, 576, 578, 580, 582, and 584. As best seen in FIGS. 14–18, the interference pads 520, 534, and 536 protrude from the exterior surface 146 of the container body 504 a small distance which is preferably selected to be smaller than the protrusion distance of the locking splines. The interference pads 520, 534, and 536 effectively increase the diameter of the container body 504 over the small angular segments they cover. Although only three interference pads 520, 534, and 536 are shown and described herein, additional interference pads could be provided at other circumferential locations on the container body 104 between adjacent pairs of locking splines.

As best seen in FIGS. 17–22*b*, the interference pads 520, 534, and 536 preferably extend longitudinally downward a small distance further than the bottoms 202 of the locking splines (i.e., toward a reference position 548 (see FIGS. 21, 22*b*) which represents the position of the closure ribs when the closure is in its closed position). If the interference ledge 176 is provided, the interference pads 520, 534, and 536 preferably extend to an intermediate position between the bottoms 202 of the locking splines and the interference ledge 176.

In addition to the interference pads 520, 534, and 536 on the container body 104, cooperative interference members 532, 538, and 540 are provided on the interior of the closure body wall 106. The interference members 532, 538, and 540 are formed as small pads located on the interior surface of the closure body wall 106, and are respectively located in positions corresponding to interference pads 520, 534, and 536 of the container body 104 when the closure is in the unlocking position. Preferably, the closure interference members 532, 538, and 540 are formed by modifying the structure of those closure ribs which correspond to the positions of the interference pads 520, 534, and 536 on the container body. The closure rib structure may be modified by undercutting the lower portion 552 (FIG.22*a*) of the rib over a distance 554 (FIGS. 15–16, 22*a*), thereby reducing its thickness, but by leaving the upper portions 546 (FIG.22*a*) of the rib unmodified at its normal thickness. Thus, the undercut portion 552 of the rib extends a small distance from the closure interior wall 106, while the unmodified portion 546 of the rib extends a somewhat greater distance from the closure interior wall 106. The unmodified portion 546 of each rib forms the closure interference members 532, 538, and 540. The closure ribs which do not have interference members may be constructed as described for containers 100 and 300.

In order to raise the closure 502 into the open position, a user must apply upward pressure on the closure 502. When light to moderate upward pressure is initially applied to the closure, the ribs on the interior of the closure 502 first encounter the interference ledge 176, if one is provided. The interference ledge 176 functions in the manner described with respect to containers 100 and 300. Once the user applies sufficient pressure to overcome the interference ledge 176, the closure 502 moves upward, and the closure ribs and interference members next encounter the container body interference pads 520, 534, and 536, which extend below the locking splines.

In order to further move the closure upward, the user must apply additional upward pressure to cause deformation of the container body with respect to the closure to overcome the obstruction caused by the engagement of the interference pad 520 with the closure interference member 540. Since at least three interference pads are provided, the identical deformation must occur at two other locations around the circumference of the container body.

FIG. 17 shows the closure 502 in its unlocking position in which the upper surface 524 of closure interference member 540 is about to encounter the bottom surface 526 of container body interference pad 520. The required deformation amount is shown schematically as distance 530, and is somewhat exaggerated for clarity. If the closure is in the unlocking position, as shown in FIG. 17, the closure ribs (and interference pads) will not encounter the container body locking splines (such as 572), but instead will pass therebetween, allowing the closure to continue to move to the open position. If the closure is not in the unlocking position, the closure ribs (and interference members) will engage the container body locking splines, thereby preventing further upward movement of the closure. Applying additional upward pressure on the closure will generally not overcome this engagement because the amount of deformation of the closure with respect to the container body required to clear the locking splines (represented by distance 556) is large.

As noted above, the undercut closure ribs advantageously reduce the amount of force needed to move the closure between the open and closed positions. For example, as the closure is moved from the closed to the open position, the closure interference members 532, 538, and 540 must pass container body interference pads 520, 534, and 536. In order for this to occur, the outer surfaces of the container body interference pads (e.g. surface 524 of pad 520, FIGS. 17 and 22*b*) must slide frictionally against the inner surface of the closure interference members (e.g. surfaces 546 of members 532, 538, and 540, see FIGS. 17 and 22*a*). As the closure continues upward, the container body interference pads reach the undercut portions of the corresponding closure ribs, and are no longer in frictional contact with the closure ribs or interference members. Thus, the undercut closure ribs reduce the distance over which the surfaces are in frictional contact, thereby reducing the amount of force needed to open and close the container 500.

The container body interference pads 520, 534, and 536 effectively conceal the unlocking position of the closure because they are encountered by closure ribs or interference members regardless of whether closure is in the unlocking position. Because the portions of the closure interference members and locking ribs which encounter the container body interference pads 520, 534, and 536 all have the same thickness, there is no way for the user to differentiate mechanically between the unlocking position and any other position. In addition, due to the serrated nature of the closure locking ribs and interference members and the container body interference pads and locking splines, edges these components cooperatively engage at a large plurality of angular orientations of the closure with respect to the container body. As a result, even if a user applies minor upward pressure while attempting to rotate the closure, the closure cannot be smoothly and continuously rotated, making it even more difficult to discover the unlocking position through mechanical trial and error.

The distance by which the closure interference members 532, 538, and 540 protrude from the closure body wall 106, and the distance by which the container body interference pads 520, 534, and 536 protrude from the container body wall 146, may depend in part on the particular material from which the container body wall 146 and closure body wall 106 are constructed, and in part on other dimensions, such as the thickness of walls 106, 146, and the diameter of these parts. These protrusion distances, and the resilience of the wall materials will affect the amount of force required to overcome the interference caused by their engagement Thus, selecting suitable protrusion distances may be important in providing a container which does not pose an unacceptable access barrier to intended users, who may have impaired strength and manual dexterity. In a tested commercial embodiment constructed of polypropylene, having a container body wall thickness 146 of 0.058 inches, a closure body wall thickness 106 of 0.025 inches, and a container body diameter of 0.656 inches, protrusion distances of 0.010 inches for the closure interference members 532, 538, and 540, and 0.010 inches for the container body interference pads 520, 534, and 536, have been found suitable.

The above-described embodiments of the invention are merely examples ways in which the invention may be carried out. Other ways may also be possible, and are within the scope of the following claims defining the invention.

What is claimed is:

1. A child-resistant dispensing container comprising a body and a closure, said body having an interfacing portion for interfacing with said closure, said interfacing portion having a longitudinal axis extending in a first direction, said closure being telescopically mounted to said body, said closure being adapted for rotation about said axis, said closure being adapted for limited movement along said first direction, said closure includes a substantially cylindrical body wall, locking means for preventing movement of said closure in said first direction unless said closure occupies a desired predetermined angular orientation with respect to said body, said locking means comprises a plurality of longitudinal slots arranged cylindrically about an interior surface of said closure body wall and extending radially outward therefrom, and means for concealing said predetermined angular orientation from mechanical discovery.

2. The container of claim 1 wherein said means for concealing said predetermined angular orientation comprises at least one defeatable interference member extending outwardly from an exterior surface of said container body.

3. The container of claim 1 wherein said means for concealing said predetermined angular orientation comprises at least one defeatable interference member extending inwardly from an interior surface of said closure.

4. The container of claim 1 wherein said locking means further comprises a plurality of longitudinal splines arranged cylindrically on an exterior surface of said container body wall at irregular angular intervals.

5. The container of claim 1 wherein said locking means slots are arranged on said interior surface of said closure body wall at irregular angular intervals.

6. The container of claim 1 wherein said locking means further comprises a plurality of longitudinal splines arranged cylindrically on an exterior surface of said container body wall, each of said plurality of splines having an angular extent along said exterior surface, and at least one of said splines having an angular extent different from the angular extent of at least one other of said splines.

7. The container of claim 1 wherein each of said locking means slots has an angular extent along said interior surface of said closure body wall, and at least one of said slots has an angular extent different from the angular extent of at least one other of said slots.

8. A child-resistant dispensing container comprising a body and a closure, said body having an interfacing portion for interfacing with said closure, said interfacing portion having a longitudinal axis extending in a first direction, said closure being telescopically mounted to said body, said closure being adapted for rotation about said axis, said closure being adapted for limited movement along said first direction, said closure includes a substantially cylindrical body wall, locking means for preventing movement of said closure in said first direction unless said closure occupies a desired predetermined angular orientation with respect to body, and means for concealing said predetermined angular orientation from mechanical discovery.

9. The container of claim 8 wherein said means for concealing said predetermined angular orientation comprises at least one defeatable interference member extending outwardly from an exterior surface of said container body.

10. The container of claim 8 wherein said means for concealing said predetermined angular orientation comprises at least one defeatable interference member extending inwardly from an interior surface of said closure.

11. The container of claim 8 wherein said locking means further comprises a plurality of longitudinal splines arranged cylindrically on an exterior surface of said container body wall at irregular angular intervals.

12. The container of claim 8 wherein said locking means further comprises a plurality of longitudinal slots arranged cylindrically on an interior surface of said container body wall at irregular angular intervals.

13. The container of claim 8 wherein said locking means further comprises a plurality of longitudinal splines arranged cylindrically on an exterior surface of said container body wall, each of said plurality of splines having an angular extent along said exterior surface, and at least one of said splines having an angular extent different from the angular extent of at least one other of said splines.

14. The container of claim 13 wherein said means for concealing said predetermined angular orientation comprises at least one defeatable interference member extending inwardly from an interior surface of said closure, said defeatable interference member being disposed substantially between two of said slots.

15. The container of claim 14 wherein:

said closure may occupy a predefined closed position with respect to said container body, said closure slots occupying a reference position when said closure is in said predefined closed position;

said container body splines extend longitudinally to a predefined end position toward said reference position;

said defeatable interference member extends beyond said predefined end position in the direction of said reference position.

16. The container of claim 8 wherein said locking means further comprises a plurality of longitudinal slots arranged cylindrically on an exterior surface of said container body wall, each of said plurality of slots having angular extent along said interior surface of said closure body wall, and at least one of said slots having an angular extent different from the angular extent of at least one other of said slots.

17. The container of claim 16 wherein said means for concealing said predetermined angular orientation comprises at least one defeatable interference member extending outwardly from an exterior surface of said container body, said defeatable interference member being disposed substantially between two of said splines.

18. Child-resistant container comprising a container body and a closure;

said container body having a portion for interfacing with said closure;

said closure adapted for slidable longitudinal movement along said interfacing portion of said container body;

a first barrier structure on said closure;

a second barrier structure on said interfacing portion;

said second barrier structure having at least one opening therein;

said first and second barrier structures cooperating to prevent longitudinal movement of said closure with respect to said interfacing portion of said container body unless said first barrier structure may enter and pass through said at least one opening;

said first and second barrier structures further cooperating to permit exclusively longitudinal movement of said closure with respect to said interfacing portion of said container body when said first barrier structure enters said at least one opening;

said interfacing portion having defeatable interference means for resisting said first barrier structures from entering said at least one opening.

19. A child-resistant dispensing container comprising: a body and a closure;

said body having a portion for interfacing with said closure;

said interfacing portion having a longitudinal axis extending in a first direction;

said closure being telescopically mounted to said body;

said closure being adapted for rotation about said axis;

said closure being adapted for limited movement along said first direction;

said container further comprising:

locking means for preventing movement of said closure in said first direction unless said closure occupies a desired predetermined angular orientation with respect to said body; and defeatable means separate from said first means for resisting movement of said closure in said first direction regardless of whether said closure occupies said predefined angular orientation with respect to said body.

20. The container of claim 19 wherein said closure is adapted for longitudinal movement with respect to said container body and said locking means interferes with said longitudinal movement unless said closure is oriented in a predefined angular relationship with said container body.

21. The container of claim 19 wherein said interface portion of said container body includes a substantially cylindrical body wall, and said locking means comprises a plurality of longitudinal splines arranged cylindrically about said body wall and extending radially outward therefrom.

22. The container of claim 19 wherein said closure includes a substantially cylindrical closure body wall, and said locking means comprises a plurality of longitudinal ribs arranged cylindrically about an interior surface of said closure body wall and extending radially inward therefrom.

23. A child-resistant dispensing container comprising a body and a closure;

said body having a dispensing aperture to permit communication of items contained in said body to the exterior of said body;

said body having a portion for interfacing with said closure;

said interfacing portion having an axis extending in a first direction;

said interfacing portion having a substantially cylindrical side wall, a first open end, and a second closed end;

said closure having a substantially cylindrical side wall, first and second ends, and an end wall attached to said side wall at said first end;

said closure being telescopically mounted to said body;

said closure being adapted for rotation about said axis;

said closure having a closed position with respect to said body portion in which said closure substantially occludes said dispensing aperture;

said closure having an open position with respect to said body portion in which said closure does not occlude said dispensing aperture and in which said closure remains telescopically mounted to said body;

said closure being adapted to move from said closed position to said open position;

said container further comprising:

first means for preventing movement of said closure from said closed position to said open position unless said closure occupies a desired predetermined angular orientation with respect to said body; and defeatable means separate from said first means for resisting movement of said closure from said closed position to said open position regardless of whether said closure occupies said predefined angular orientation with respect to said body.

24. The container of claim 23 wherein:

said closure further comprises means for sealing said container extending from said end wall toward said second end of said closure;

said means for sealing being adapted to engage said first open end of said interfacing portion of said container body;

said means for sealing comprising a cylindrical lip extending from said end wall of said closure.

25. The container of claim 24 wherein said means for sealing has an interior region and said closure further comprises an indentation in said closure end wall extending into said interior region of said seal.

26. The container of claim 23 wherein:

said closure further comprises means for sealing said container extending from said end wall toward said second end of said closure;

said means for sealing being adapted to engage said first open end of said interfacing portion of said container body;

said means for sealing is spaced from said cylindrical side wall of said closure.

27. A child-resistant dispensing container comprising:

a substantially cylindrical body having a first closed end and a second end opposite said first end;

a substantially cylindrical closure captively and telescopically mounted to said second end of said body;

said body having a substantially cylindrical wall portion including a first dispensing orifice therein;

said closure having a substantially cylindrical wall portion including a second dispensing orifice therein;

said body and said closure cooperating to permit dispensing of items in said container exclusively when said first and said second dispensing orifices are disposed in overlapping alignment;

said body and said closure having a plurality of splines longitudinally disposed on surfaces thereof for prohibiting longitudinal movement of said closure with respect to said body unless said closure occupies a desired predetermined angular orientation with respect to said body; and said body having at least one barrier surface for defeatably resisting longitudinal movement of said closure with respect to said body unless said closure occupies a desired predetermined angular orientation with respect to said body.

28. A child-resistant dispensing container comprising:

a base and a closure;

said base having a substantially cylindrical interface portion for interfacing with said closure;

said interface portion having a longitudinal axis extending along a first direction;

said closure being telescopically affixed to said base at said interface portion;

said closure being adapted for translation along said first direction and for rotation about said axis;

said base having a first aperture for dispensing items contained therein;

said closure having a wall portion including a second aperture;

and said closure having a closed position in which said first and second apertures are unaligned and an open position in which said first and second apertures are disposed in overlapping alignment, said closure and said base cooperating to prohibit dispensing of said items whenever said first and said second apertures are unaligned;

said base and said closure having cooperative first means for restricting movement of said closure from said closed position to said open position unless said closure occupies a desired predetermined angular orientation with respect to said base; and said base and said closure having cooperative defeatable means separate from said first means for resisting movement of said closure from said closed position to said open position regardless of whether said closure occupies said predefined angular orientation with respect to said base.

29. A child-resistant dispensing container comprising:

a base and a closure;

said closure being telescopically mounted to said base;

said closure being adapted for longitudinal movement with respect to said base and for angular rotation about said base;

said base having a substantially cylindrical wall portion including a first dispensing aperture therein;

said closure having a substantially cylindrical wall portion including a second dispensing aperture therein;

said base and said closure cooperating to permit dispensing of items in said container exclusively when said first and said second dispensing apertures are disposed in overlapping alignment;

said closure having an open position with respect to said base in which said first and second dispensing apertures are disposed in overlapping alignment, and a range of closed positions with respect to said base in which said first and second dispensing apertures are unaligned;

said base and said closure having first cooperative means for permitting substantially exclusively longitudinal movement of said closure from said range of closed positions into said open position;

said first cooperative means prohibiting said longitudinal movement of said closure unless said closure is disposed in a predefined angular orientation with respect to said base; and said base and said closure having cooperative defeatable means separate from said first cooperative means for resisting movement of said closure from said closed position to said open position regardless of whether said closure occupies said predefined angular orientation with respect to said base.

* * * * *